US005203273A

United States Patent [19]

Sandlofer

[11] Patent Number: 5,203,273

[45] Date of Patent: Apr. 20, 1993

[54] OIL SPILL RAPID RESPONSE, CONTAINMENT AND STOPPAGE METHOD AND APPARATUS

[75] Inventor: Michael I. Sandlofer, Bronx, N.Y.

[73] Assignee: North Wind Undersea Institute, Inc., Bronx, N.Y.

[21] Appl. No.: 704,327

[22] Filed: May 23, 1991

[51] Int. Cl.[5] ..... B63B 43/16

[52] U.S. Cl. ..... 114/229; 114/227

[58] Field of Search ..... 114/270, 227, 228, 229; 210/242.1, 242.4

[56] References Cited

U.S. PATENT DOCUMENTS

| | | | |
|---|---|---|---|
| 373,133 | 11/1887 | Duncan . | |
| 1,070,260 | 8/1913 | Jameson . | |
| 1,099,167 | 6/1914 | Czerniawski . | |
| 1,192,661 | 7/1916 | Marsden . | |
| 1,192,662 | 7/1916 | Marsden . | |
| 1,221,496 | 4/1917 | Wullyamoz | 114/227 |
| 1,345,771 | 7/1920 | Hewett | 114/229 |
| 1,573,909 | 2/1926 | Blumberg | 114/229 |
| 3,183,876 | 5/1965 | Kronhaus | 114/229 |
| 3,400,684 | 9/1968 | Gerardi | 114/229 |
| 3,617,566 | 11/1971 | Oshima et al. | 210/40 |
| 3,904,528 | 9/1975 | Yocum | 210/242 |
| 4,026,233 | 5/1977 | Cox | 114/229 |
| 4,497,712 | 2/1985 | Cowling | 210/691 |
| 4,565,468 | 1/1986 | Crawford | 405/270 |
| 4,981,097 | 1/1991 | Beyrouty | 114/228 |
| 5,071,545 | 12/1991 | Ashtary | 114/270 |

FOREIGN PATENT DOCUMENTS

| | | |
|---|---|---|
| 246898 | 6/1987 | Fed. Rep. of Germany . |
| 1306806 | 4/1987 | U.S.S.R. . |

*Primary Examiner*—Sherman Basinger
*Assistant Examiner*—Thomas J. Brahan
*Attorney, Agent, or Firm*—Ronald A. Krasnow

[57] ABSTRACT

A skin, preferably a rip-stop material with a dehydrated material thereon, is rapidly deployed to surround an oil transportation ship spilling oil from a hole or breach in the hull. The skin is snugged up to the hull to allow the dehydrated material to absorb the spilling oil, and also preferably expanding into and filling the hole or breach. The skin is stored on-board the ship on a storage spool.

19 Claims, 7 Drawing Sheets

FIG.1A
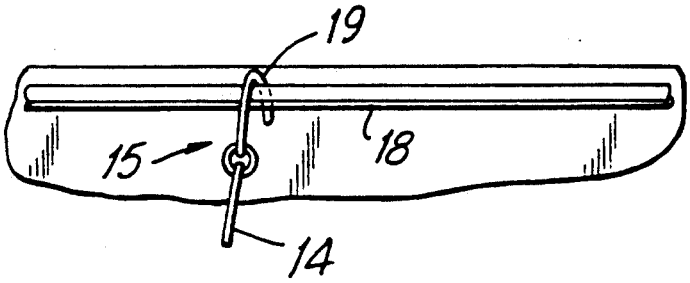
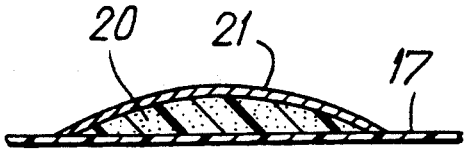
FIG.2A
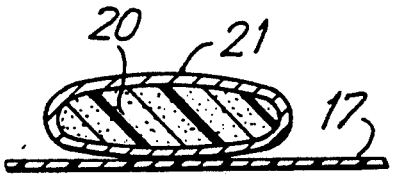
FIG.2A1
FIG.2B
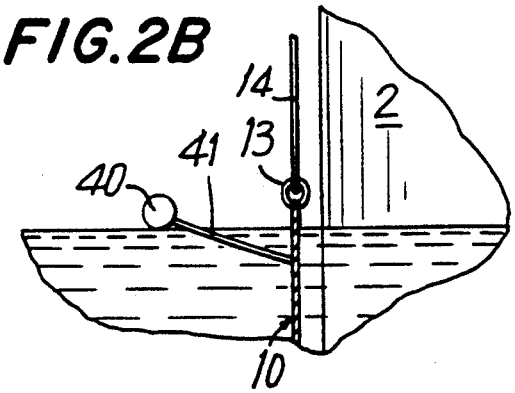
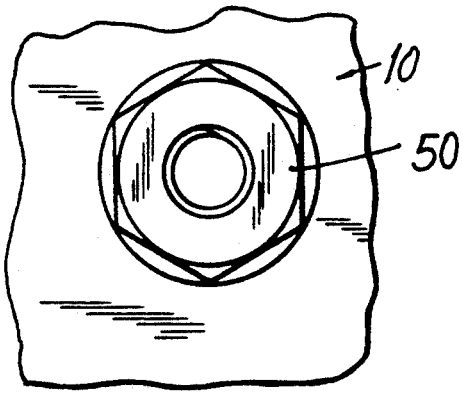
FIG.7

OIL SPILL RAPID RESPONSE, CONTAINMENT AND STOPPAGE METHOD AND APPARATUS

BACKGROUND OF THE INVENTION

This invention relates to an apparatus and method for stopping, containing and responding to oil spills. More particularly, this invention relates to an apparatus and method for rapid deployment of a form fitted skin under and around the hull of a ship that is spilling oil.

Oil spillage by oil transportation ships is becoming a common event around the world. The majority of this spillage results from damaged hulls. Rapid repsonse to these spills is crucial to success of containment. Specifically, working within a tide and current time table, as soon as the hull has been penetrated time is of the essence. Rapid response to an oil spill increases the possibilities of reduced spillage and reduced harm to the environment. Thus, a need exists for an apparatus and method to respond quickly to oil spills. Further, the need exists to contain and stop the oil spills once they have started.

One type of system is disclosed in U.S. Pat. No. 4,981,097 to Beyrouty. There, an on-board oil spill "prevention" and recovery system employs a plurality of oil sorbent pillows. Pillows are released into the oil holding tank and an oil sorbent boom is deployed when a puncture in the ship's hull occurs. However, this system has the disadvantage of requiring recovery of any pillows which fall through the ruptured hull. Also, the sorbent boom functions the same way as those booms which are known in the prior art. See for example, U.S. Pat. No. 3,702,657 to Cunningham et al. wherein an oil boom with adsorbent material disposed thereon collects oil from contaminated water. Other methods for sealing holes from the inside of the hull are disclosed in Russian disclosure 1,306,806 and German Patent 246,898.

Also known are devices for emergency repair of ship hulls to prevent the ship from sinking. U.S. Pat. No. 373,133 to Duncan, U.S. Pat. No. 1,070,260 to Jameson, U.S. Pat. No. 3,183,876 to Kronhaus, U.S. Pat. No. 3,400,684 to Gerardi and U.S. Pat. No. 4,026,233 to Cox all disclose tarps, covers or sheaths to encase a portion or all of the hull of a boat or ship which has a hole, rent, opening, crack or breach. Each of these devices is designed to provide a water-tight barrier to prevent water from entering the vessel. However, none of them disclose a device that prevents oil or other cargo from leaving the ship or vessel.

A slightly different variation is disclosed in U.S. Pat. No. 1,573,909 to Blumberg. Blumberg discloses use of a mattress to cover a hole in the hull of a ship or boat. The mattress also comprises a means for allowing a pipe or hose through the mattress for the purpose of pumping water out of the hull. The mattress does not cover the entire hull of the ship.

In the manner described below, this invention overcomes the inefficiencies and ineffectiveness of the devices and methods currently known in the art. The invention provides an apparatus and method to surround a damaged oil transportation vessel with a snug fitting skin to plug any holes in the hull with a water tight seal. It is the only device known to the applicant which will allow a damaged oil transportation ship to be towed or moved prior to emptying of the oil holding tanks. This result stems from the invention providing a method and apparatus to not only respond rapidly to contain an oil spill, but also stop the oil spill.

This invention is an inexpensive option compared other to ideas considered concerning oil spills. For example, the U.S. Congress is considering requiring oil transportation ships to have a double hull, which is one hull inside another. This suggestion has expensive fuel and capacity considerations. Also, a double hull does not prevent an oil spill. Thus, while a double hull will lessen the damage to the hull of a ship and impliedly reduce oil spillage, employment of double hull in the existing fleet of ships is unlikely in the foreseeable future. The invention described herein gives oil shippers an option to avoid expensive modifications to existing ships.

SUMMARY OF THE INVENTION

In view of the above, it is an object of this invention to provide a rapid oil spill response method and apparatus.

It is another object of this invention to provide an oil spill containment method and apparatus.

It is still another object of this invention to provide a method and apparatus to stop oil from spilling out of the storage holding tank of a damaged oil transportation ship.

It is a further object of this invention to provide a on-board oil spill rapid response, containment and stoppage apparatus and method.

It is yet a further object of this invention to provide an oil spill rapid response, containment and stoppage apparatus and method that is not completely dependant on on-shore facilities.

It is still a further object of this invention to allow the oil transportation ship to be towed or moved with an oil spill rapid response, containment and stoppage apparatus in place around the hull of the ship.

It is yet a further object of this invention to provide a quickly deployable, easily stowed, flexible, water-tight, rip-stop skin to respond, contain and stop an oil spill.

It is an additional object of this invention to provide a form-fitted skin that can be deployed under most weather conditions by a trained crew.

These and other objects, which will be apparent to one of ordinary skill in the art, are met by a rip-stop skin fitted to the hull for a specific ship. The skin is deployed preferably by a hydraulic containment reel being lowered into position at the stern of the ship. A bridle attaches one end of the skin to a cable that is connected to a bow winch. The bow winch takes up the slack of the cable to deploy the skin under the hull. The bow winch continues to operate to bring the form-fitted skin into contact with the ship's hull. There are several embodiments to snug the skin up to the hull of the ship.

Compartments of dehydrated material may be incorporated as part of the rip-stop skin. The dehydrated material is preferably, principally, oil absorbent and may be conventional. The compartments of dehydrated material are preferably encased in a water tight, yet also water soluble, material, which may also be conventional. The encasing material prevents the dehydrated material from absorbing water during skin deployment. After deployment and a predetermined period of time, the encasing material dissolves in the water allowing the dehydrated material to absorb the fluid it is contacting. It is important to have the skin deployed and contacting or snugged up to the ship's hull before the encasing material dissolves. Once the encasing material dissolves, the dehydrated material begins to absorb oil spilling out of the hull from the hole or breach in the hull. The dehydrated material expands as it absorbs the oil or other fluid, thereby filling any hole or breach in the hull.

Once the invention is in operation, the oil transportation ship may be towed for emptying and repair. Additionally, the oil cargo may be transfered to another ship. Optionally attached to the invention is a means to allow the oil to be reclaimed from the water within the skin.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which:

FIG. 7 shows one embodiment of a flange connection in the skin.

DETAILED DESCRIPTION

Figure 1:
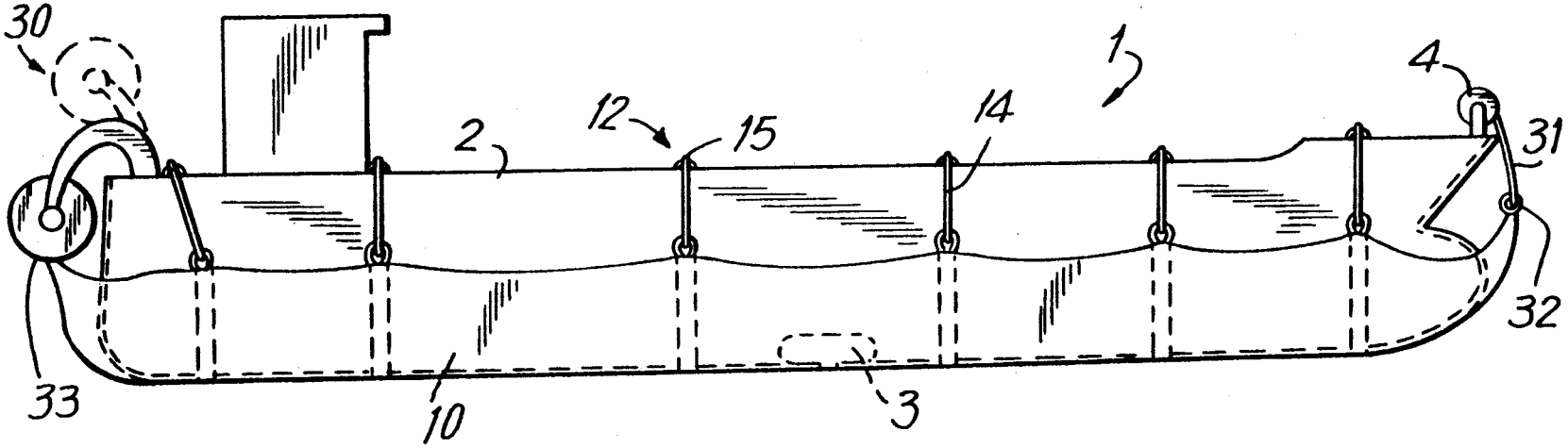
FIG. 1 is a side view of a ship with the invention deployed, with FIG. 1A being a detail of the securing rail attached to the ship.

This invention is for an oil spill rapid response, containment and stoppage apparatus and method. While an oil transportation ship is employed as the principal example, it will be understood that this invention can be employed for any transportation ship that can discharge a harzardous cargo. As shown in FIG. 1, the apparatus requires a deployment means 30, a skin 10 comprising an outer material 17 and a dehydrated material 20, and a securing means 12. The skin 10 is stored on-board the ship on a storage spool 33. On-board storage eliminates total dependance on on-shore facilities and decreases or improves the response time in dealing with an oil spill. This invention can be depolyed in a variety of sea and weather conditions.

In operation, the deployment means 30 is employed to lower the storage spool 33 over the side of the ship 1. A cable 31 extends between one end of the skin 10 and a winch 4 and is drawn up by activating the winch 4 as the skin 10 is payed out under the ship 1. As the skin 10 is payed out, securing means 12 are employed to secure the skin along the sides of the ship 1. The skin 10 is snugged up to the hull 2 of the ship 1 by the winch 4, securing means 12 or other devices designed to snug the skin up to the hull. A dehydrated material 20, inside an encasing material, is part of the skin 10. The dehydrated material absorbs the oil and expands to fill the hole or breach 3 in the hull 2.

Figure 2:
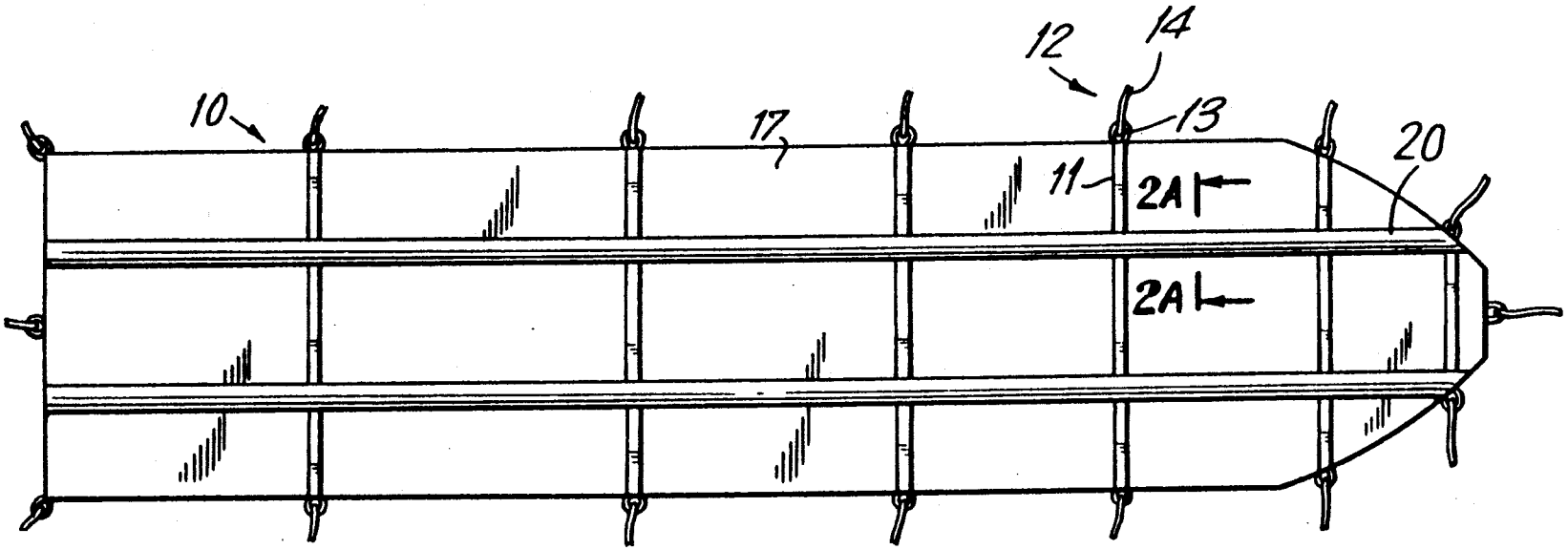
FIG. 2 is an embodiment of the layout of the skin employed, with FIGS. 2A and 2A-1 showing alternative details of cutout section A—A, and FIG. 2B being a detail of the skin with a boom attachment.
Figure 3:
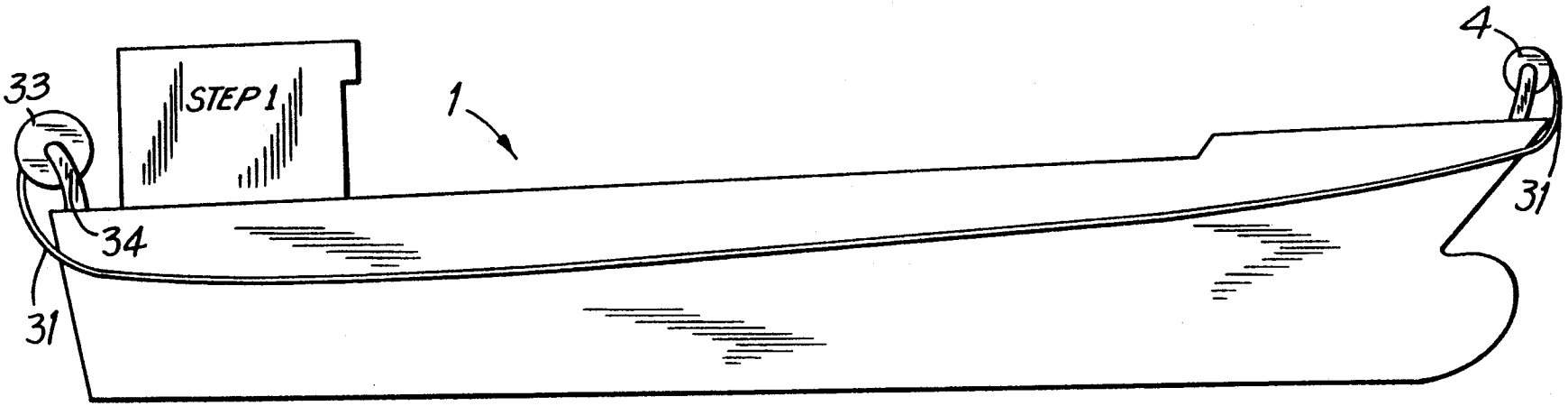
FIG. 3 depicts Step 1 in the deployment of the skin.

Referring now to FIG. 2, there is shown in detail the skin 10 of this invention. The skin 10 preferably comprises two components: an outer material 17 and a dehydrated material 20. The outer material 17 is preferably a rip-stop material. A rip-stop material is a material that resists holes or tears. Once the rip-stop material has a hole or tear, it resists further ripping stemming from the original hole or tear. The rip-stop material should be flexible, waterproof and resistant to oil. Additionally, the rip stop material must generally be suitable for the marine and oil industry environment. Rip-stop materials of this type, which can be form-fitted, are generally known to those of skill in the art.

The skin 10 also comprises a dehydrated material 20. The dehydrated material 20 is attached to the inside of the outer material 17 in any geometric shape or pattern that is desirable. The shape or pattern of the dehydrated material on the outer material will depend on the size and shape of the hull. For example, the dehydrated material may line a substantial portion of the skin, i.e. more than 50%. In a preferred embodiment, shown in FIG. 2, the dehydrated material 20 forms strips running the length of the skin. These strips are along the portion of the hull which runs the greatest risk of being cracked or breached.

The dehydrated material may be any material that expands in size upon the absorption of a fluid. The fluid absorbed is preferably oil, but may also be water or other fluids encountered during an oil spill. Expansion in size means any expansion, no matter how small or large. The most preferred embodiments of the invention incorporate a material that expands sufficiently to fill the hole or crack in the hull spilling oil to stop the flow of oil from the hull.

To keep the dehydrated material 20 dry during deployment of the skin 10, the invention preferably employs an encasing material 21. FIG. 2A, which shows section A—A from FIG. 2, depicts the outer material 17 as the outer layer of the skin that encounters the water after skin deployment. The dehydrated material 20 is encased between the outer material 17 and the encasing material 21. With this configuration, the dehydrated material is sealed against contact with water or other fluids during storage and deployment. In an alternative embodiment, the dehydrated material 20 is entirely encased in the encasing material 21 as shown in FIG. 2A-1. This embodiment adds the advantage that the dehydrated material 20 may be moved to the location of the hole or breach. The movement would occur after deployment of the skin 10. The movement is between the outer material 17 and the hull 2.

The encasing material 21 is any material that will dissolve in water over a period of time. This period of time is at least the amount of time that it will take to deploy the skin. The preferred period of time is in the range of from about 30 minutes to 2 hours. Most preferably, a crew with proper training could depoly this invention in less than 30 minutes. In operation, the encasing material will dissolve after the skin has been deployed. At this point, the dehydrated material is in close relation or in contact with the hole or breach that is spilling oil. The dehydrated material begins absorbing the spilling oil and thus begins expanding. As more oil is absorbed, the dehydrated material expands to fill the hole or breach thereby stopping the flow of oil out of the ship.

In a preferred embodiment, the skin is fitted to the hull of a specific ship. Every ship is required to enter dry dock at some time for inspection and repair. At that time, a ship employing this invention will be fitted with a skin that is measured from the keel to a point at or near the water line of the ship when fully loaded. The skin could also be sized generally to fit the hull of a class of ships, but should still come to a point at or near the water line of the ship when fully loaded. At or near the water line means that the top rim of the skin, in the deployed state, is above or below the actual water line of the ship. Preferably, the top rim of the skin is above the water line so that the skin can stop the flow of oil into the surrounding water.

An additional feature of the skin of this invention is the ability to modify the shape of the skin at the water line to meet a specific need. During an oil spill, it is impossible to stop the flow of oil out of the hull before some oil has entered the water. It is desirable to have a portion of the skin wider than the hull at the water line to give the skin the ability to contain any oil that has spilled into the water before the skin could be deployed. Optionally, the skin may additionally comprise an oil containment boom. Any oil boom may be employed, such as those described in U.S. Pat. No. 4,981,097 to Beyrouty.

The oil boom may be attached by any of a number of methods. For example, the boom may be the outer edge of the skin. Alternatively, the boom may be a separate portion of the skin, as shown in detail in FIG. 2B. There is shown the skin 10 deployed alongside the hull 2. At the water line, a boom 40 is employed to capture any spilled oil. The boom 40 is attached to the skin 10 by a boom attachment means 41. The boom attachment means 41 can be any thing which secures the boom to the skin, including ropes, line, cable or a continuous sheet of material. The continuous sheet of material is preferable rip-stop material.

The securing means 12 secures the skin 10 to the ship. FIG. 2 displays the skin portion of the securing means. In the preferred embodiment, the skin is secured using a plurality of hooks 13 appropriately spaced along the outer edge of the skin 10. The number of hooks employed depends on the size of the ship. The number of hooks 13 should be sufficient to maintain the skin in a position consistent with the description of this invention. Lines 14 are attached to the hooks 13. See also FIG. 2B showing the detail of the securing means 12.

Referring FIG. 1, as the skin 10 is payed out into position under the hull 2, the lines 14 are secured to ship-board securing means 15. The shipboard securing means can be cleats located on the freeboard deck of the ship or the top deck of the ship. The cleats are spaced to correspond to the locations of the hooks on the as-deployed skin.

In the most preferred embodiment, the shipboard securing means 15 is a securing rail 18 located on the outer side of the ship's hull 2, as shown in FIG. 1A. In this embodiment, the lines 14 have catches 19 attached at one end. As the skin is deployed, the lines 14 are recovered from the water and the catches are secured to the securing rail 18. Therefore, as the skin is continually depolyed, the catches 19 slide along the securing rail 18. The securing rail 18 is located on any part of the hull 2 to allow the catches 19 to slide along the rail as the skin is deployed. The form-fitted skin is thus depolyed such that it will fit snuggly to the hull.

The skin 10 is securely attached to the ship 1 with these securing means 12. The securing means are preferably attached to the skin 10 at locations corresponding to the locations of reinforcing strips 11. Reinforcing strips 11 give the skin 10 greater strength at the points where the skin is snugged up and secured to the ship. The reinforcing strips may, however, be used in any portion of the skin requiring additional strength. Reinforcing strips are typically appropriately spaced throughout the skin. Reinforcing strips are preferably made of wire cable encased in nylon or other plastic to avoid chafing the ship.

The skin 10 is deployed, using a deployment means, as shown in FIGS. 3–6. Looking first at FIG. 3, there is shown the skin stored on a storage spool 33 that is attached to the ship with a spool support 34. The storage spool 33 and spool support 34 are preferably hydraulic reels as known to those skilled in the art. In another embodiment, the storage spool and spool support may be either pneumatic or may operate by gravity should there be a total breakdown of the onboard facilities. One end of the skin, while on the storage spool 33, is connected to a cable 31 that is run the length of the ship to a winch 4. In the most preferred embodiment, the cable 31 is kept in this connected position throughout the time that the invention may be employed. This preferred embodiment allows for a faster response to any accident or other event that causes a hole or breach in the hull resulting in an oil spill. The preferred embodiment of the deployment means is shown having the storage spool 33 at the stern of the ship with the winch 4 at the bow of the ship. It should be understood that their respective locations may be reversed. It is sufficient for the purposes of this invention that the storage spool and the winch are at opposite ends of the ship.

Figure 4:
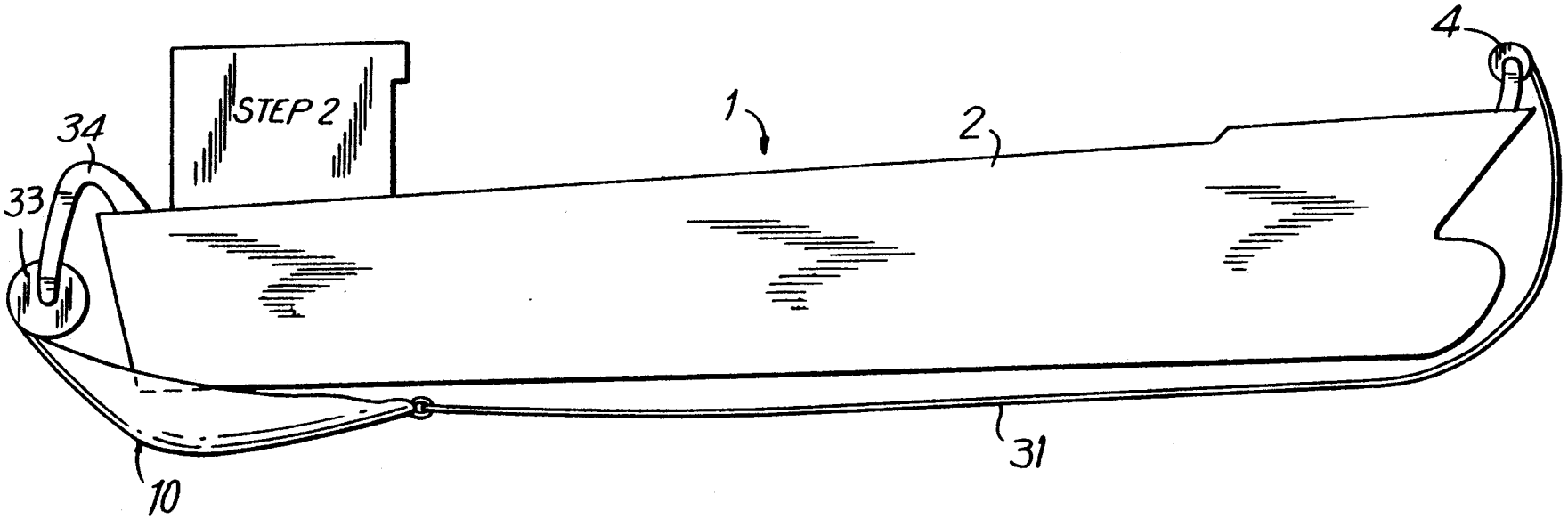
FIG. 4 depicts Step 2 in the deployment of the skin.
Figure 5:
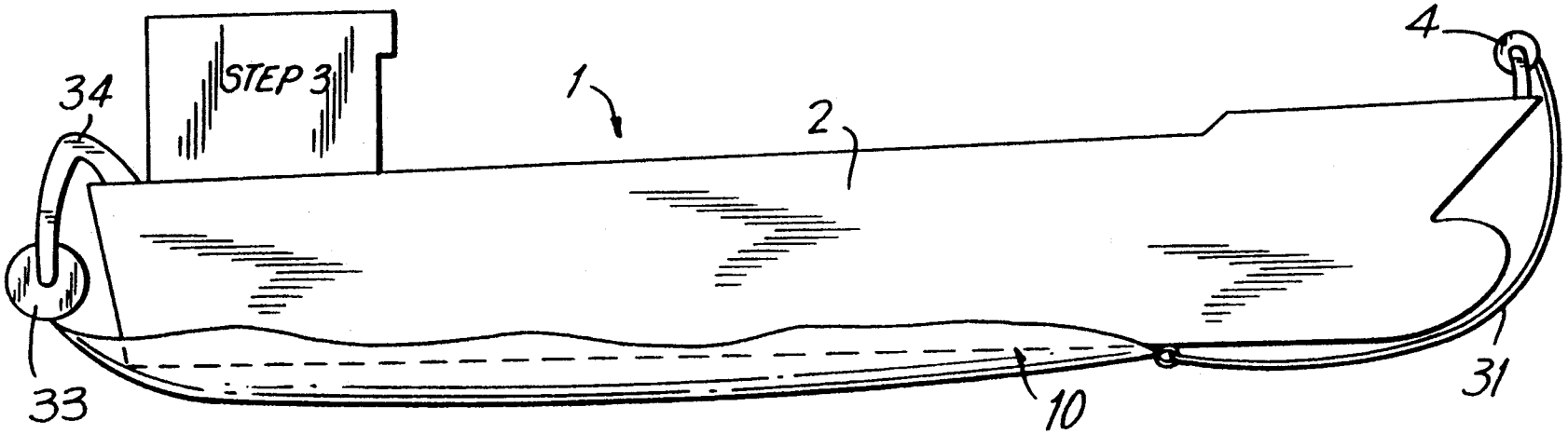
FIG. 5 depicts Step 3 in the deployment of the skin.

As shown in FIG. 4, the storage spool 33 is lowered over the side of the ship 1 by the spool support 34. After the cable 31 has been connected to both the skin 10 and the winch 4, the winch 4 is activated and begins to take up the slack of the cable 31 as the skin is payed out from the storage spool 33. Thus, the skin 10 is drawn under the hull 2. See also FIG. 5 where the skin 10 is more full deployed.

Figure 6:
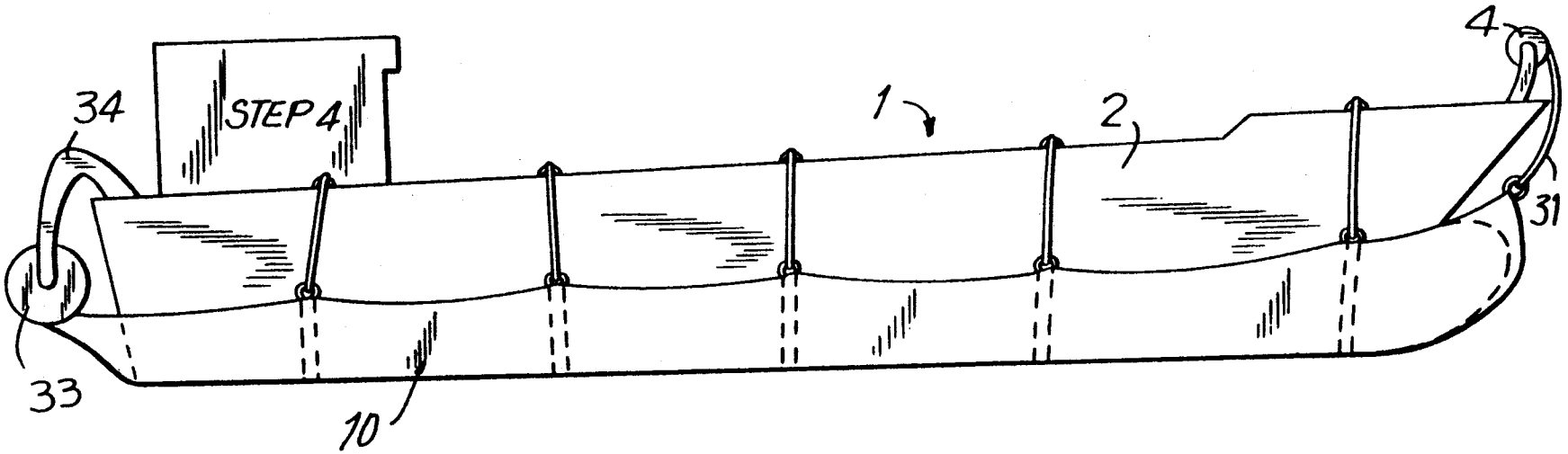
FIG. 6 depicts Step 4 in the deployment of the skin, the final step.

The securing means 12 is attached to the ship as the skin 10 is deployed. The fully deployed and secured skin is shown in FIG. 6. Once the skin 10 is surrounding the hull, the winch continues to operate to snug the skin to the hull.

One of the important features of this invention is the ability to have the skin snugged up to the hull. Specifically, this means that the skin should be in close relation to the hull. More specifically, the dehydrated material must be in close proximity to the hole or breach in the hull that is spilling oil. The close proximity should be maintained for a sufficient amount of time to allow the encasing material to dissolve and the dehydrated material to expand upon the absorption of the spilling oil. In the most preferred embodiment, the skin acts as a second skin for the hull up to the water line. Known marine engineering principles are relied upon to force the skin against the hull after it is snugged up. However, should the skin not be close enough to the hull for the dehydrated material to be effective, a number of possible methods can be used for snugging the skin to the hull.

One embodiment employs the use of a pump to pump out the water between the hull and the skin. As shown in FIG. 7, the pump is connected to a flange connection 50 that is part of the skin 10. The flange connection 50 can be at any part of the skin. A flange connection near the keel may by used for snugging the skin to the hull by pumping out trapped water. Further, there can be a plurality of flange connections in the skin used for different purposes. For example, a flange connection at the water line may be used for skimming spilled oil off the water. Another embodiment uses air charges to bring the skin up to the water line. A gas manifold located on board the ship can be used to inflate or deflate a gas bladder when desired, to take up slack and force the skin flush against the hull. The gas bladder can be in sections along the outer edge of the skin.

In an alternative embodiment, shown in FIG. 1, the securing means 12 may be used to snug the skin 10 up to the ship 1. Specifically, the lines 14 are connected to winches to draw in the ropes or cables. This will draw the skin closer to the ship at several locations thereby forcing any captured water over the upper edge of the skin.

Cutouts may be provided at desired locations on the skin to allow for sea suctions, propellers or ship rudders.

While particular embodiments of the invention have been presented, it should be understood that various changes and modifications to the oil spill rapid response, containment and stoppage method and apparatus can be made without departing from the scope and spirit of the invention.

What is claimed is:

1. An oil spill rapid response, containment and stoppage apparatus, comprising: a skin comprising an outer material and a dehydrated material, a means for securing the skin to a ship and a deployment means for the skin wherein said skin is of sufficient size to cover at least a portion of the hull of the ship below the water line.

2. The apparatus of claim 1, wherein at least a portion of the outer material of the skin is a rip-stop material.

3. The apparatus of claim 1, wherein the skin fits around the hull from the keel to a point at or near the water line of a fully loaded ship.

4. The apparatus of claim 1, wherein the skin additionally comprises an oil boom attached to the outer edge of the skin.

5. The apparatus of claim 1, wherein the skin additionally comprises reinforcing strips.

6. The apparatus of claim 1, wherein the securing means comprises a plurality of hooks along an outer edge of the skin, a plurality of catches attached to the hooks with rope, and a securing rail secured to the ship, wherein the catches secure the skin to the ship by attaching to the securing rail.

7. The apparatus of claim 1, wherein the dehydrated material is encased in a water tight seal between the outer material and an encasing material.

8. The apparatus of claim 7, wherein the encasing material dissolves in water after a predetermined period of time.

9. The apparatus of claim 8, wherein the encasing material dissolves in a period of time of from about 30 minutes to about 2 hours.

10. The apparatus of claim 7, wherein the dehydrated material expands upon contact with a fluid.

11. The apparatus of claim 1, wherein the dehydrated material is encased in an encasing material.

12. The apparatus of claim 11, wherein the encasing material dissolves in water after a predetermined period of time.

13. The apparatus of claim 12, wherein the encasing material dissolves in a period of time of from about 30 minutes to about 2 hours.

14. The apparatus of claim 11, wherein the dehydrated material expands upon contact with a fluid.

15. The apparatus of claim 1, wherein the deployment means comprises a storage spool connected to the ship by a spool support, a winch attached to the ship at an end of the ship opposite from the storage spool, and a cable connected at one end to the winch and at its other end to one end of the skin, wherein the skin is wound around the storage spool prior to deployment.

16. The apparatus of claim 1, wherein the skin further comprises a flange connection.

17. A method for responding to, containing and stopping an oil spill from an oil transportation ship, comprising the steps of deploying a skin that surrounds the ship, providing dehydrated material attached to the skin, placing the dehydrated material in close proximity to a breach in the ship from which oil is spilling, and maintaining the dehydrated material in said proximity to allow it to expand and fill said breach.

18. The method of claim 12, wherein the dehydrated material is deployed encased in a water tight seal.

19. The method of claim 18, wherein the deploying step comprises the steps of lowering a storage spool containing the skin over the edge of the ship using a spool support, connecting a cable from one end of the skin to a winch located at an opposite end of the ship from the storage spool, activating the winch to take up the cable and pay out the skin, snugging the skin up to the hull, and securing the skin to the ship.

* * * * *